US009898978B2

(12) United States Patent
Guo et al.

(10) Patent No.: US 9,898,978 B2
(45) Date of Patent: Feb. 20, 2018

(54) LIQUID CRYSTAL PANELS AND THE DRIVING CIRCUITS THEREOF

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Xingling Guo, Guangdong (CN); Jinjie Zhou, Guangdong (CN); Yujie Bai, Guangdong (CN)

(73) Assignees: Shenzhen China Star Optoelectronics Technology Co., Ltd, Shenzhen, Guangdong (CN); WUHAN CHINA STAR OPTOELECTRONICS TECHNOLOGY CO., LTD, Wuhan, Hubei (CN)

( * ) Notice: Subject to any disclaimer, the term of this patent is extended or adjusted under 35 U.S.C. 154(b) by 213 days.

(21) Appl. No.: 14/787,019

(22) PCT Filed: Sep. 2, 2015

(86) PCT No.: PCT/CN2015/088823

§ 371 (c)(1),
(2) Date: Oct. 26, 2015

(87) PCT Pub. No.: WO2017/024644

PCT Pub. Date: Feb. 16, 2017

(65) Prior Publication Data

US 2017/0221436 A1 Aug. 3, 2017

(30) Foreign Application Priority Data

Aug. 12, 2015 (CN) ..... 2015 1 0493248

(51) Int. Cl.
*G09G 3/36* (2006.01)

(52) U.S. Cl.
CPC ..... *G09G 3/3614* (2013.01); *G09G 3/3607* (2013.01); *G09G 3/3688* (2013.01);
(Continued)

(58) Field of Classification Search
CPC ..... G09G 5/20; G09G 3/36; G09G 3/3607
See application file for complete search history.

(56) References Cited

U.S. PATENT DOCUMENTS 6,331,846 B1 * 12/2001 Nakao ..... G09G 3/3614 330/252
7,746,335 B2 6/2010 Hsu
(Continued)

FOREIGN PATENT DOCUMENTS

CN 101510395 A 8/2009
CN 103293810 A 9/2013
(Continued)

*Primary Examiner* — Olga Merkoulova
(74) *Attorney, Agent, or Firm* — Andrew C. Cheng

(57) ABSTRACT

The present disclosure relates to a liquid crystal panel and the driving circuit. The liquid crystal panel includes a plurality of source driving circuits and a plurality of sub-pixel rows extending along a row direction. Each of the sub-pixel rows includes a plurality of sub-pixels of different colors and the sub-pixels are arranged periodically along the row direction. Within one scanning frame, polarity of driving voltage of at least one sub-pixel within the arranging period is opposite to that of other sub-pixels. Each of the source driving circuit includes at least two output ends respectively connecting to at least two sub-pixels having the same polarity of driving voltage within the same scanning frame to provide the driving voltage of the same polarity to the at least two sub-pixels. In this way, the power consumption of the source driving circuit may be reduced.

16 Claims, 5 Drawing Sheets

(52) U.S. Cl.
CPC ..... *G09G 2300/0452* (2013.01); *G09G 2320/0247* (2013.01); *G09G 2330/021* (2013.01)

(56) References Cited

U.S. PATENT DOCUMENTS

| | | | | |
|---|---|---|---|---|
| 2002/0039096 | A1* | 4/2002 | Katsutani | G09G 3/3688 345/204 |
| 2002/0041274 | A1* | 4/2002 | Watanabe | G09G 3/3614 345/204 |
| 2006/0087484 | A1* | 4/2006 | Kumeta | G09G 3/3688 345/96 |
| 2006/0119557 | A1 | 6/2006 | Sano et al. | |
| 2006/0158420 | A1 | 7/2006 | Chang et al. | |
| 2010/0110114 | A1* | 5/2010 | Hashimoto | G09G 3/3614 345/691 |
| 2010/0295843 | A1 | 11/2010 | Liu et al. | |
| 2010/0328360 | A1 | 12/2010 | Miyashita | |
| 2015/0380435 | A1 | 12/2015 | Li et al. | |

FOREIGN PATENT DOCUMENTS

| | | | |
|---|---|---|---|
| CN | 103558720 | A | 2/2014 |
| CN | 203551912 | U | 4/2014 |

* cited by examiner

LIQUID CRYSTAL PANELS AND THE DRIVING CIRCUITS THEREOF

BACKGROUND OF THE INVENTION

1. Field of the Invention

The present disclosure relates to liquid crystal display technology, and more particularly to a liquid crystal panel and a driving circuit thereof.

2. Discussion of the Related Art

LCDs typically are characterized by attributes including thin, flicker-free, power-saving, and thus are the main trend of displays.

The LCDs mainly rely on optical characteristics of liquid crystal to display. The driving voltage of liquid crystal molecules cannot be fixed at one value, or the liquid crystal molecules may be polarized and optical rotation features may disappear. To protect such features, usually, the liquid crystal panel may be driven by polarity inversion methods. At this moment, the driving voltage of the pixel electrodes may include two polarities. The polarity is positive when the driving voltage of the pixel electrode is greater than the voltage of the common electrode, and the polarity is negative when the driving voltage of the pixel electrode is smaller than the voltage of the common electrode. The absolute value of the voltage difference between the pixel electrodes and the common electrode is fixed regardless of whether the driving voltage of the pixel electrode is positive or negative, and thus the displayed grayscale are all the same.

The polarity-inversion methods generally includes dot inversion, row version, row inversion, and frame inversion. Compared with other inversion methods, row inversion method is characterized by low power consumption and low flicker, and thus has been widely adopted by LCDs. With respect to the row inversion method, within one frame, the polarity of the driving voltage of the sub-pixels in the same row is the same, and that of the sub-pixels in the adjacent row is opposite. In addition, in order to enhance the brightness, usually, one additional sub-pixel (W) is supplemented to the original three sub-pixels (RGB). Thus, as shown in FIG. 1, when the row inversion method is applied to the RGBW pixel structure, the polarity of the driving voltage of the four sub-pixels (RGBW) is usually configured to be positive, negative, negative, and positive. Each source driver 11 corresponds to one set of four sub-pixels (RGBW) for providing the driving voltage to the four sub-pixels (RGBW).

However, in the above driving method, as the driving voltage of the four sub-pixels (RGBW) may be positive or negative, and thus the source driver 11 has to switch between the positive voltage and the negative voltage, which increases the power consumption of the source driver 11.

SUMMARY

The object of the invention is to provide a liquid crystal panel and the driving circuit thereof for reducing the power consumption of the driving circuit.

In one aspect, a liquid crystal panel includes: a plurality of source driving circuits and a plurality of sub-pixel rows extending along a row direction, each of the sub-pixel rows includes a plurality of sub-pixels of different colors and the sub-pixels being arranged periodically along the row direction, within one scanning frame, polarity of driving voltage of at least one sub-pixel within the arranging period being opposite to that of other sub-pixels, and the polarity of each of the sub-pixels within the arranging period being the same with or being opposite to that of the sub-pixels of corresponding color of adjacent arranging period; each of the source driving circuit includes at least two output ends respectively connecting to at least two sub-pixels having the same polarity of driving voltage within the same scanning frame to provide the driving voltage of the same polarity to the at least two sub-pixels, wherein a number of the output ends of each of the source driving circuits being the same with the sub-pixels within each of the arranging periods, each of the source driving circuit being configured for obtaining voltage data corresponding to the sub-pixels within two adjacent arranging periods, wherein the sub-pixels having the same polarity of driving voltage within the same scanning frame, and the source driving circuit being configured for outputting via the four output ends, the output ends respectively connecting to the sub-pixels of two adjacent arranging periods, and wherein the polarity of the driving voltage of sub-pixels within the same scanning control signals being the same; and within one arranging period, the color of the corresponding sub-pixels of the adjacent sub-pixel row being the same.

Wherein each of the sub-pixel rows comprises a first base-color sub-pixel, a second base-color sub-pixel, a third base-color sub-pixel, and a fourth base-color sub-pixel arranged periodically arranged the row direction, within the same arranging period, the polarity of the driving voltage of the first base-color sub-pixel and the fourth base-color sub-pixel are the same, the polarity of the driving voltage of the second base-color sub-pixel and the third base-color sub-pixel are the same, the polarity of the driving voltage of the first base-color sub-pixel is opposite to that of the second base-color sub-pixels, and the polarity of the driving voltage of each of the sub-pixel within each of the arranging period is opposite to that of the sub-pixels within adjacent arranging period having the same color; and each of the source driving circuit comprises four output ends, two of the output ends connect with the first base-color sub-pixel and the fourth base-color sub-pixel within one arranging period, the other two output ends respectively connect to the second base-color sub-pixel and the third base-color sub-pixel within the other arranging period adjacent to the arranging period.

Wherein each of the sub-pixel rows comprises a first base-color sub-pixel, a second base-color sub-pixel, a third base-color sub-pixel, and a fourth base-color sub-pixel arranged periodically arranged the row direction, within the same arranging period, the polarity of the driving voltage of the first base-color sub-pixel and the fourth base-color sub-pixel are the same, the polarity of the driving voltage of the second base-color sub-pixel and the third base-color sub-pixel are the same, the polarity of the driving voltage of the first base-color sub-pixel is opposite to that of the second base-color sub-pixels, and the polarity of the driving voltage of each of the sub-pixel within each of the arranging period is the same with that of the sub-pixels within adjacent arranging period having the same color; each of the source driving circuit comprises four output ends respectively connecting to the first base-color sub-pixel and the third base-color sub-pixel within two adjacent arranging periods, or respectively connecting to the second base-color sub-pixel and the fourth base-color sub-pixel within two adjacent arranging periods.

Wherein the liquid crystal panel further comprises a converting circuit connecting with the source driving circuit for converting the voltage data of three base color sets into voltage data of four base color sets, one set of the first base-color sub-pixel, the second base-color sub-pixel, the third base-color sub-pixel, and fourth base-color sub-pixel within one arranging period corresponds to the voltage data of the four base color set.

Wherein the liquid crystal panel further comprises four control lines, each of the source driving circuit comprises a data processing unit, a source IC chip, and four switches; the data processing unit connects with the converting circuit for obtaining the voltage data corresponding to the sub-pixels of two adjacent arranging periods having the same polarity of the driving voltage within the same scanning frame, and for outputting the obtained voltage data to the source IC chip; and the source IC chip comprises an input end and an output end, the switch comprises an input end, an output end, and a control end, the input end of the source IC chip connects to the data processing unit, the output end of the source IC chip connects to the input end of the four switches, the output ends of the four switches connects to the four output ends of the source driving circuit, and the control end of the four switches respectively connect to the four control lines.

Wherein the first base-color sub-pixels, the second base-color sub-pixels, the third base-color sub-pixels, and the fourth base-color sub-pixels within one arranging period are respectively red sub-pixel, green sub-pixel, blue sub-pixel, and white sub-pixel.

In another aspect, a liquid crystal panel includes: a plurality of source driving circuits and a plurality of sub-pixel rows extending along a row direction, each of the sub-pixel rows includes a plurality of sub-pixels of different colors and the sub-pixels being arranged periodically along the row direction, within one scanning frame, polarity of driving voltage of at least one sub-pixel within the arranging period being opposite to that of other sub-pixels; and each of the source driving circuit includes at least two output ends respectively connecting to at least two sub-pixels having the same polarity of driving voltage within the same scanning frame to provide the driving voltage of the same polarity to the at least two sub-pixels.

Wherein within the same scanning control signals, the polarity of each of the sub-pixels within each of the arranging periods is the same with or is opposite to that of the sub-pixels of corresponding color of adjacent arranging period; a number of the output ends of each of the source driving circuits is the same with the sub-pixels within each of the arranging periods, each of the source driving circuit is configured for obtaining voltage data corresponding to the sub-pixels within two adjacent arranging periods, wherein the sub-pixels having the same polarity of driving voltage within the same scanning frame, and the source driving circuit is configured for outputting via the four output ends, the output ends respectively connecting to the sub-pixels of two adjacent arranging periods, and wherein the polarity of the driving voltage of sub-pixels within the same scanning control signals are the same.

Wherein each of the sub-pixel rows comprises a first base-color sub-pixel, a second base-color sub-pixel, a third base-color sub-pixel, and a fourth base-color sub-pixel arranged periodically arranged the row direction, within the same arranging period, the polarity of the driving voltage of the first base-color sub-pixel and the fourth base-color sub-pixel are the same, the polarity of the driving voltage of the second base-color sub-pixel and the third base-color sub-pixel are the same, the polarity of the driving voltage of the first base-color sub-pixel is opposite to that of the second base-color sub-pixels, and the polarity of the driving voltage of each of the sub-pixel within each of the arranging period is opposite to that of the sub-pixels within adjacent arranging period having the same color; and each of the source driving circuit comprises four output ends, two of the output ends connect with the first base-color sub-pixel and the fourth base-color sub-pixel within one arranging period, the other two output ends respectively connect to the second base-color sub-pixel and the third base-color sub-pixel within the other arranging period adjacent to the arranging period.

Wherein each of the sub-pixel rows comprises a first base-color sub-pixel, a second base-color sub-pixel, a third base-color sub-pixel, and a fourth base-color sub-pixel arranged periodically arranged the row direction, within the same arranging period, the polarity of the driving voltage of the first base-color sub-pixel and the fourth base-color sub-pixel are the same, the polarity of the driving voltage of the second base-color sub-pixel and the third base-color sub-pixel are the same, the polarity of the driving voltage of the first base-color sub-pixel is opposite to that of the second base-color sub-pixels, and the polarity of the driving voltage of each of the sub-pixel within each of the arranging period is opposite to that of the sub-pixels within adjacent arranging period having the same color; and each of the source driving circuit comprises four output ends, two of the output ends connect with the first base-color sub-pixel and the fourth base-color sub-pixel within one arranging period, the other two output ends respectively connect to the second base-color sub-pixel and the third base-color sub-pixel within the other arranging period adjacent to the arranging period.

Wherein the liquid crystal panel further comprises a converting circuit connecting with the source driving circuit for converting the voltage data of three base color sets into voltage data of four base color sets, one set of the first base-color sub-pixel, the second base-color sub-pixel, the third base-color sub-pixel, and fourth base-color sub-pixel within one arranging period corresponds to the voltage data of the four base color set.

Wherein the liquid crystal panel further comprises four control lines, each of the source driving circuit comprises a data processing unit, a source IC chip, and four switches; the data processing unit connects with the converting circuit for obtaining the voltage data corresponding to the sub-pixels of two adjacent arranging periods having the same polarity of the driving voltage within the same scanning frame, and for outputting the obtained voltage data to the source IC chip; and the source IC chip comprises an input end and an output end, the switch comprises an input end, an output end, and a control end, the input end of the source IC chip connects to the data processing unit, the output end of the source IC chip connects to the input end of the four switches, the output ends of the four switches connects to the four output ends of the source driving circuit, and the control end of the four switches respectively connect to the four control lines.

Wherein the first base-color sub-pixels, the second base-color sub-pixels, the third base-color sub-pixels, and the fourth base-color sub-pixels within one arranging period are respectively red sub-pixel, green sub-pixel, blue sub-pixel, and white sub-pixel.

Wherein within one arranging period, the color of the corresponding sub-pixels of the adjacent sub-pixel row is the same.

In another aspect, a driving circuit of liquid crystal panels includes: the liquid crystal panel includes a plurality of sub-pixel rows extending along a row direction, each of the sub-pixel rows includes a plurality of sub-pixels of different colors and the sub-pixels being arranged periodically along the row direction, within one scanning frame, polarity of driving voltage of at least one sub-pixel within the arranging period being opposite to that of other sub-pixels; wherein the driving circuit includes a plurality of source driving circuits, each of the source driving circuit includes at least two output ends respectively connecting to at least two sub-pixels having the same polarity of driving voltage within the same scanning frame to provide the driving voltage of the same polarity to the at least two sub-pixels.

Wherein within the same scanning control signals, the polarity of each of the sub-pixels within each of the arranging periods is the same with or is opposite to that of the sub-pixels of corresponding color of adjacent arranging period; a number of the output ends of each of the source driving circuits being the same with the sub-pixels within each of the arranging periods, each of the source driving circuit being configured for obtaining voltage data corresponding to the sub-pixels within two adjacent arranging periods, wherein the sub-pixels having the same polarity of driving voltage within the same scanning frame, and the source driving circuit being configured for outputting via the four output ends, the output ends respectively connecting to the sub-pixels of two adjacent arranging periods, and wherein the polarity of the driving voltage of sub-pixels within the same scanning control signals are the same.

In view of the above, the output ends of each of the source driving circuit respectively connects to the sub-pixels having the same polarity within one scanning frame. Thus, within one scanning frame, the source driving circuit only needs to output the driving voltage with the same polarity. This prevents the source driving circuit from switching between the positive driving voltage and the negative driving voltage, which not only reduces the switching range of the voltage but also reduces the power consumption of the source driving circuit.

DETAILED DESCRIPTION OF THE EMBODIMENTS

Embodiments of the invention will now be described more fully hereinafter with reference to the accompanying drawings, in which embodiments of the invention are shown.

Figure 1:
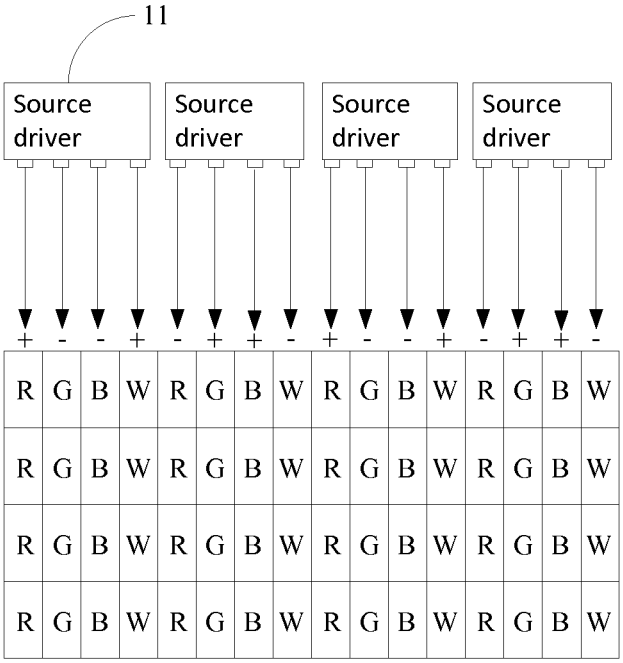
FIG. 1 is a schematic view of driving principle of one conventional liquid crystal panel.
Figure 2:
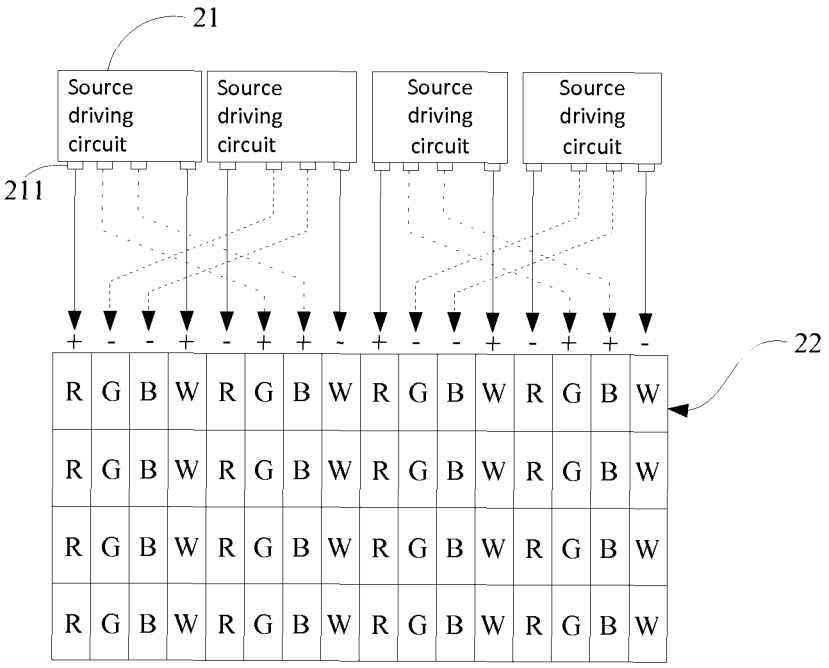
FIG. 2 is a schematic view of the liquid crystal panel in accordance with one embodiment.

FIG. 2 is a schematic view of the liquid crystal panel in accordance with one embodiment. The liquid crystal panel includes a plurality of source driving circuits 21 and a plurality of sub-pixel rows 22. The source driving circuits 21 are arranged within an non-display area of the liquid crystal panel for providing the driving voltage to the sub-pixels. The sub-pixel rows 22 are arranged along a row direction, and are arranged within a display area of the liquid crystal panel so as to display images.

In the embodiment, each of the sub-pixel rows 22 includes a plurality of sub-pixels having different colors arranged periodically along the row direction. Each of the sub-pixel is defined by a data line and a scanning line. One sub-pixel row connects with one scanning line, and one sub-pixel column connects with one scanning line. In the embodiment, each of the sub-pixel rows 22 includes a first base-color sub-pixel (R), a second base-color sub-pixel (G), a third base-color sub-pixel (B), and a fourth base-color sub-pixel (W) arranged periodically arranged the row direction. The first base-color sub-pixel (R), the second base-color sub-pixel (G), the third base-color sub-pixel (B), and the fourth base-color sub-pixel (W) are respectively a red sub-pixel, a blue sub-pixel, a green sub-pixel, and a white sub-pixel. It can be understood that the first base-color sub-pixel (R), the second base-color sub-pixel (G), the third base-color sub-pixel (B), and the fourth base-color sub-pixel (W) may be divided into the red sub-pixel, the blue sub-pixel, the green sub-pixel and the yellow sub-pixel, or the sub-pixel having other color.

Within the same scanning frame, the polarity of the driving voltage of two base-color sub-pixels are different from that of the other two base-color sub-pixels so as to implement the row inversion driving. Specifically, within the same scanning frame, the polarity of the driving voltage of the first base-color sub-pixel (R) and the fourth base-color sub-pixel (W) are the same, and the polarity of the driving voltage of the second base-color sub-pixel (G) and the third base-color sub-pixel (B) are the same. The polarity of the driving voltage of the first base-color sub-pixel (R) and the fourth base-color sub-pixel (W) is opposite to that of the second base-color sub-pixel (G) and the third base-color sub-pixel (B). One scanning frame relates to the time period of scanning one sub-pixel row.

In addition, within the same scanning frame, the polarity of the driving voltage of each of the base-color sub-pixels is opposite to that of the driving voltage of the corresponding base-color sub-pixels.

Taking the liquid crystal panel as one example, within one scanning frame, the first base-color sub-pixel (R), the second base-color sub-pixel (G), the third base-color sub-pixel (B), and the fourth base-color sub-pixel (W) are arranged in a first arranging period from the left side. The polarity of the first base-color sub-pixel (R), the second base-color sub-pixel (G), the third base-color sub-pixel (B), and the fourth base-color sub-pixel (W) are respectively positive, negative, negative, and positive. The first base-color sub-pixel (R), the second base-color sub-pixel (G), the third base-color sub-pixel (B), and the fourth base-color sub-pixel (W) of the second arranging period, which is adjacent to the first arranging period, are respectively negative, positive, positive, and negative. When all of the sub-pixel rows are scanned, within one frame, the driving voltage of the first sub-pixel column, i.e., the column of the first base-color sub-pixels (R), is the same with that of the fourth sub-pixel column, i.e., the column of the fourth base-color sub-pixels (W). The driving voltage of the second sub-pixel column, i.e., the column of the second base-color sub-pixels (G), is the same with that of the third sub-pixel column, i.e., the column of the third base-color sub-pixels (B).

In addition, when all of the sub-pixel rows are scanned, the polarity of the first base-color sub-pixel (R), the second base-color sub-pixel (G), the third base-color sub-pixel (B), and the fourth base-color sub-pixel (W) in the next scanning frame may be negative, positive, positive, and negative, which is opposite to the polarity of the previous scan. The first base-color sub-pixel (R), the second base-color sub-pixel (G), the third base-color sub-pixel (B), and the fourth base-color sub-pixel (W) of the second arranging period, which is adjacent to the first arranging period, are respectively negative, positive, positive, and negative, which is opposite to the previous scan. In this way, the row inversion driving method is implemented.

In view of the above, the crosstalk and the flicker may be reduced. In other embodiments, the polarity of the driving voltage of the sub-pixel having the same colors of two adjacent arranging period may be the same.

In the embodiment, each of the source driving circuit 21 includes four output ends 211. The number of the output ends 211 is the same with the number of the sub-pixels within each of the arranging period. Each of the output ends of the source driving circuit may be configured in accordance with the polarity of the driving voltage needed by each of the sub-pixels within each of the arranging period.

Specifically, the four output ends 211 of each of the source driving circuits 21 respectively connects to the four base-color sub-pixels having the same polarity of the driving voltage within the same scanning frame so as to provide the driving voltage having the same polarity to the four base-color sub-pixels. In addition, each of the source driving circuit 21 is configured for obtaining voltage data corresponding to the four base-color sub-pixel having the same polarity within the same scanning frame, and for outputting via the four output ends 211. The output ends 211 respectively connects to the four base-color sub-pixels of two adjacent arranging periods, and the four base-color sub-pixel have the same polarity of driving voltage within the same scanning frame.

As shown in FIG. 2, two of the output ends 211 of the first source driving circuit 21 located in the leftmost side connect with the first base-color sub-pixel (R) and the fourth base-color sub-pixel (W) within the first arranging period. The other two output ends 211 respectively connect to the second base-color sub-pixel (G) and the third base-color sub-pixel (B) within the second arranging period so as to provide the driving voltage having the same polarity to the four base-color sub-pixels. Two output ends 211 of the second source driving circuit 21 respectively connect to the first base-color sub-pixel (R) and the fourth base-color sub-pixel (W) within the second arranging period, and the other two output ends 211 respectively connect to the second base-color sub-pixel (G) and the third base-color sub-pixel (B) within the first arranging period, which is adjacent to the second arranging period so as to provide the driving voltage having the same polarity to the four base-color sub-pixels. The relationship between the output ends of other source driving circuits and the sub-pixels within each of the arranging periods may be configured in a similar way, and thus is omitted hereinafter.

It is to be noted that the output ends connect with the sub-pixels relate to the output ends connect with the corresponding sub-pixels via corresponding data lines so as to apply the driving voltage to the sub-pixels via the data lines. In addition, each of the output ends connects one data line so as to provide the driving voltage to the sub-pixel row connected with the data line.

Thus, within the same scanning frame, the polarity of the driving voltage outputted by the four output ends 211 of each of the source driving circuit 21 are the same. Compared with the conventional driving method, the source driving circuit 21 only needs to output the driving voltage having one polarity within one scanning frame, and thus the source driving circuit 21 is prevented from switching between the positive driving voltage and the negative driving voltage. In this way, the voltage switching range is limited so as to reduce the power consumption of the source driving circuit.

Figure 3:
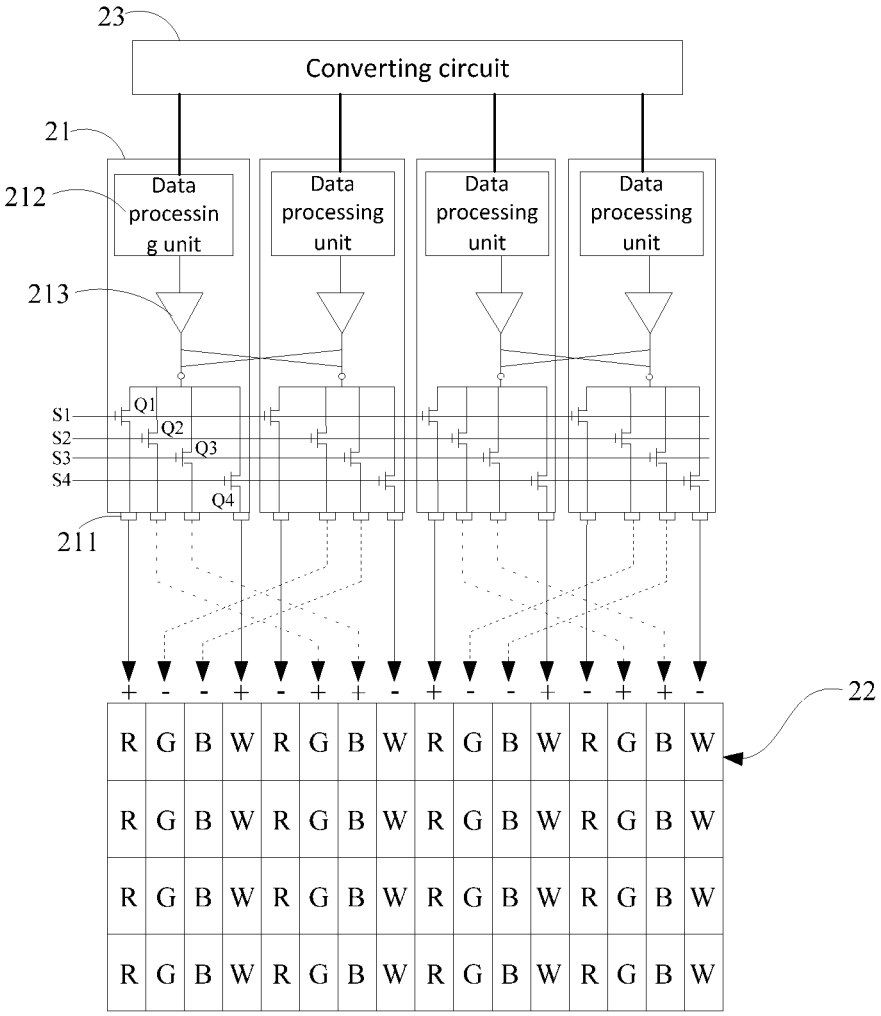
FIG. 3 is a schematic view of the liquid crystal panel in accordance with another embodiment.

Referring to FIG. 3, the liquid crystal panel further includes a converting circuit 23 and four control lines (S1-S4). Each of the source driving circuit 21 includes a data processing unit 212, a source IC chip 213, and four switches (Q1-Q4).

The converting circuit 23, the four control lines (S1-S4), and the source driving circuit 21 may be within T-Con or outside the T-Con.

The converting circuit 23 is configured for converting the voltage data of RGB base color sets into voltage data of four base color sets. One set of the first base-color sub-pixel (R), the second base-color sub-pixel (G), the third base-color sub-pixel (B), and fourth base-color sub-pixel (W), i.e., within one arranging period, correspond to the voltage data of RGBW base color set. The data processing unit 212 connects with the converting circuit 23 for obtaining the voltage data corresponding to the sub-pixels of two adjacent arranging periods having the same polarity of the driving voltage within the same scanning frame. As shown in FIG. 3, the data processing unit 212 of the first source driving circuit 21 located in the leftmost side is configured for obtaining the voltage data corresponding to the first base-color sub-pixel (R) and the fourth base-color sub-pixel (W) within the first arranging period and the voltage data corresponding to the second base-color sub-pixel (G) and the base-color sub-pixels within the second arranging period, wherein the sub-pixels within the same arranging period having the same polarity of the driving voltage. The obtained voltage data is then outputted to the source IC chip 213. The operations of the data processing units of other source driving circuit is similar to the above. Thus, each of the source driving circuit 21 may output correct voltage data.

The source IC chip 213 includes an input end and an output end. The switch includes an input end, an output end, and a control end. The input end of the source IC chip 213 connects to the data processing unit 212, the output end of the source IC chip 213 connects to the input end of the four switches (Q1-Q4). The output ends of the four switches (Q1-Q4) connects to the four output ends 211 of the source driving circuit 21. The control end of the four switches (Q1-Q4) respectively connect to the four control lines (S1-S4). The four control lines (S1-S4) is configured for turning on and off the switches (Q1-Q4). When the four switches (Q1-Q4) are turned on, the source IC chip 213 transmits the voltage data to the corresponding sub-pixels via the switches.

In view of the above, the row inversion driving method may be accomplished so as to reduce the flicker and the power consumption of the source driving circuit 21.

Figure 4:
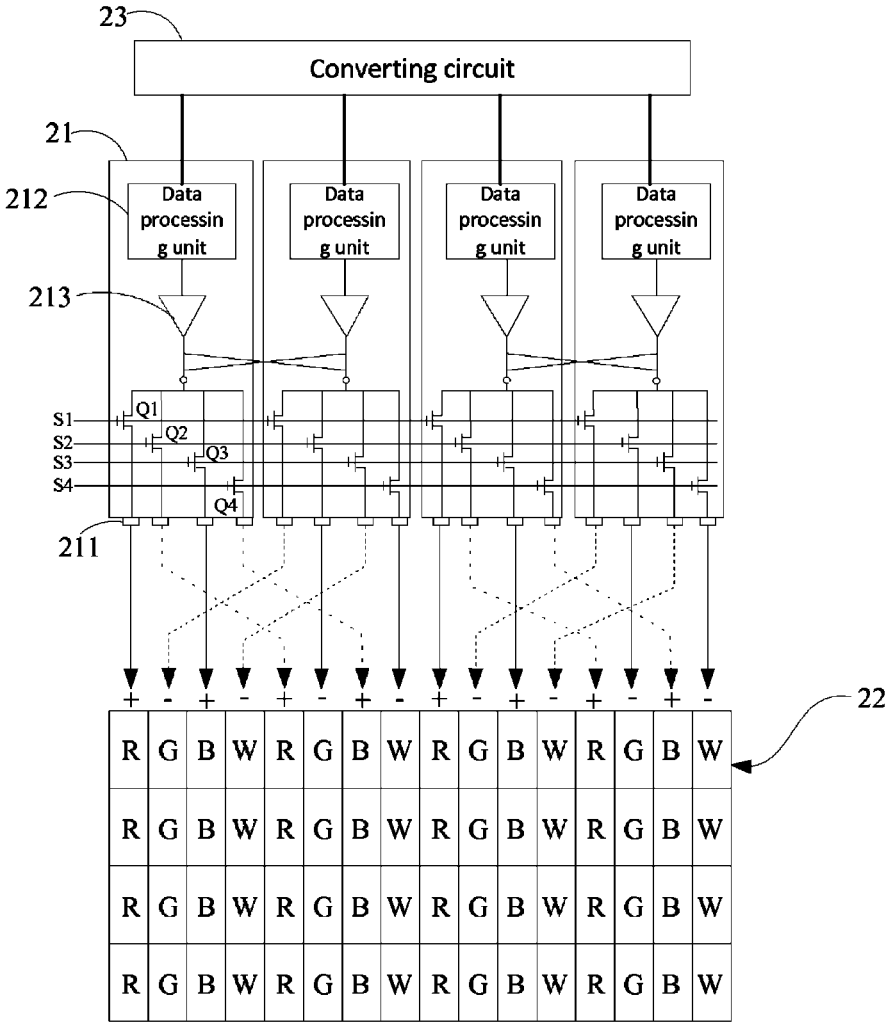
FIG. 4 is a schematic view of the liquid crystal panel in accordance with another embodiment.

FIG. 4 is a schematic view of the liquid crystal panel in accordance with another embodiment. The difference between FIG. 3 and FIG. 4 resides in that the polarity of the driving voltage of two adjacent sub-pixels within the same arranging period are opposite to each other. The polarity of the driving voltage of the sub-pixels having the same color within two adjacent arranging periods are the same. Specifically, the polarity of the driving voltage of the first base-color sub-pixel (R) and the third base-color sub-pixel (B) within the same arranging period is the same, and that of the second base-color sub-pixel (G) and the fourth base-color sub-pixel (W) are the same. The polarity of the driving voltage of the first base-color sub-pixel (R) and the second base-color sub-pixel (G) are opposite to each other. The polarity of the driving voltage of the first base-color sub-pixel (R) within two adjacent arranging periods are the same. The polarity of the driving voltage of other base-color sub-pixels within two adjacent arranging periods may be understood in a similar way.

As shown in FIG. 4, within the same scanning frame, the polarity of the driving voltage of the first base-color sub-pixel (R), the second base-color sub-pixel (G), the base-color sub-pixels and the base-color sub-pixels, from the leftmost to the rightmost, are respectively positive, negative, positive, and negative. The polarity of the driving voltage of the first base-color sub-pixel (R), the second base-color sub-pixel (G), the third base-color sub-pixel (B), and the fourth base-color sub-pixel (W), within the second arranging period adjacent to the first arranging period, are respectively positive, negative, positive, and negative.

In the embodiment, the four output ends of each of the source driving circuit 21 respectively connect to the first base-color sub-pixel (R) and the third base-color sub-pixel (B) within two adjacent arranging periods, or respectively connect to the second base-color sub-pixel (G) and the fourth base-color sub-pixel (W) within two adjacent arranging periods. As shown in FIG. 4, the four output ends of the first source driving circuit 21 respectively connect to the first base-color sub-pixel (R) and the third base-color sub-pixel (B) within the first arranging period, and the first base-color sub-pixel (R) and the base-color sub-pixels within the second arranging period so as to provide the driving voltage of the same polarity to the four sub-pixels. The four output ends of the second source driving circuit 21 respectively connect to the second base-color sub-pixel (G) and the fourth base-color sub-pixel (W) within the first arranging period and the second base-color sub-pixel (G) and the fourth base-color sub-pixel (W) within the second arranging period so as to provide the driving voltage of the same polarity to the four sub-pixels.

Figure 5:
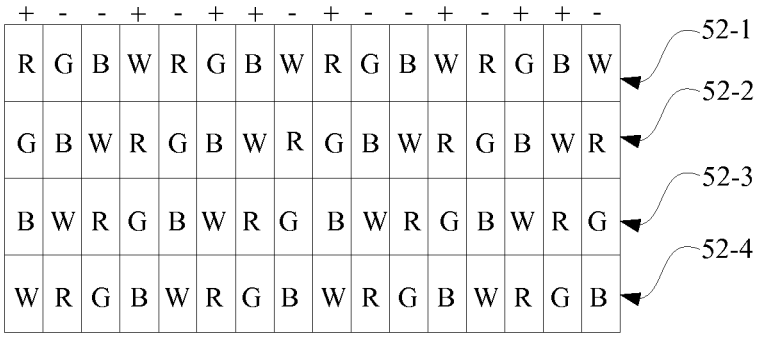
FIG. 5 is a schematic view of the sub-pixel arrangement in accordance with another embodiment.

In the above embodiments, as shown in FIGS. 2-4, the first base-color sub-pixels, the second base-color sub-pixels, the third base-color sub-pixels, and the fourth base-color sub-pixels within one arranging period are respectively red sub-pixel, green sub-pixel, blue sub-pixel, and white sub-pixel. Each of the sub-pixel column includes the sub-pixels of the same color. In other embodiments, the sub-pixels of one arranging period and within two adjacent sub-pixel rows may correspond to different colors. As shown in FIG. 5, regarding the first sub-pixel row 52-1 within one arranging period, the first base-color sub-pixels, the second base-color sub-pixels, the third base-color sub-pixels, and the fourth base-color sub-pixels are respectively the red sub-pixel, the green sub-pixel, the blue sub-pixel, and the white sub-pixel. Regarding the second sub-pixel row 52-2 within one arranging period, the first base-color sub-pixels, the second base-color sub-pixels, the third base-color sub-pixels, and the fourth base-color sub-pixels are respectively the green sub-pixel, the blue sub-pixel, the white sub-pixel, and the red sub-pixel. Regarding the third sub-pixel row 52-3 within one arranging period, the first base-color sub-pixels, the second base-color sub-pixels, the third base-color sub-pixels, and the fourth base-color sub-pixels are respectively the blue sub-pixel, the white sub-pixel, the red sub-pixel, and the green sub-pixel. Regarding the fourth sub-pixel row 52-4 within one arranging period, the first base-color sub-pixels, the second base-color sub-pixels, the third base-color sub-pixels, and the fourth base-color sub-pixels are respectively the white sub-pixel, the red sub-pixel, the green sub-pixel, and the blue sub-pixel. Every four sub-pixel columns constitutes one arranging period. Thus, one sub-pixel row includes the sub-pixel of four colors.

Figure 6:
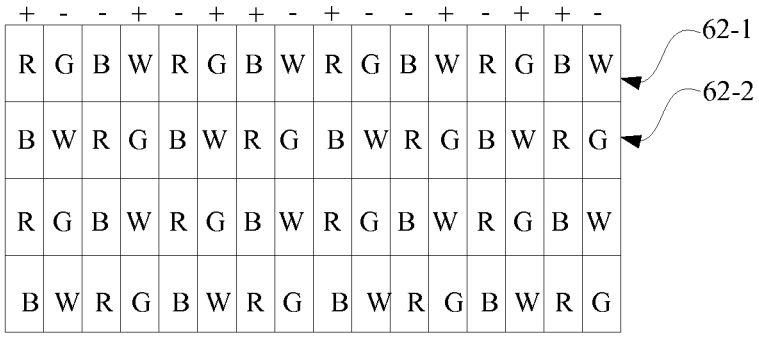
FIG. 6 is a schematic view of the sub-pixel arrangement in accordance with another embodiment.

In an example, one sub-pixel row may include the sub-pixels of two colors. Referring to FIG. 6, regarding the first sub-pixel row 62-1 within one arranging period, the first base-color sub-pixels, the second base-color sub-pixels, the third base-color sub-pixels, and the fourth base-color sub-pixels are respectively the red sub-pixel, the green sub-pixel, the blue sub-pixel, and the white sub-pixel. Regarding the second sub-pixel row 62-1 within one arranging period, the first base-color sub-pixels, the second base-color sub-pixels, the third base-color sub-pixels, and the fourth base-color sub-pixels are respectively the blue sub-pixel, the white sub-pixel, the red sub-pixel, and the green sub-pixel. Every two sub-pixel columns constitutes one arranging period.

Although the arrangement of the sub-pixels in FIGS. 5 and 6 are different from that of the FIGS. 2-4, but the sub-pixels in FIGS. 5 and 6 may be driven by the driving circuit in FIGS. 2-4 so as to reduce the power consumption.

In other embodiments, the number of the sub-pixels in one arranging period may be two, three, ore more than three. In an example, the polarity of the driving voltage of only one sub-pixel is opposite to that of the other sub-pixels. For instance, the polarity of the driving voltage of one sub-pixel is positive, and that of the other sub-pixels are negative. In addition, the number of the output ends of the source driving circuit may be two, three, or more than three as long as the output ends of the source driving circuit connects to the sub-pixels having the same polarity of the driving voltage.

In the present disclosure, a liquid crystal panel includes a driving circuit, and the driving circuit may be any one of the source driving circuit in the above embodiments.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal panel, comprising:

a plurality of source driving circuits and a plurality of sub-pixel rows extending along a row direction, each of the sub-pixel rows comprising a plurality of sub-pixels of different colors and the sub-pixels being arranged periodically along the row direction, within one scanning frame, polarity of driving voltage of at least one sub-pixel within one arranging period being opposite to that of other sub-pixels, and the polarity of each of the sub-pixels within the arranging period being the same with or being opposite to that of the sub-pixels of corresponding color of adjacent arranging period;

each of the source driving circuit comprising at least two output ends respectively connecting to at least two sub-pixels having the same polarity of driving voltage within the same scanning frame to provide the driving voltage of the same polarity to the at least two sub-pixels, wherein a number of the output ends of each of the source driving circuits being the same with the sub-pixels within each of the arranging periods, each of the source driving circuit being configured for obtaining voltage data corresponding to the sub-pixels within two adjacent arranging periods, wherein the sub-pixels having the same polarity of driving voltage within the same scanning frame, and the source driving circuit being configured for outputting via the four output ends, the output ends respectively connecting to the sub-pixels of two adjacent arranging periods, and wherein the polarity of the driving voltage of sub-pixels in the same scanning frame being the same;

the color of each of the sub-pixels being the same with the corresponding sub-pixel within the adjacent arranging periods;

the liquid crystal panel further comprising four control lines, each of the source driving circuit comprising a data processing unit, a source IC chip, and four switches; and the source IC chip comprising: an input end and an output end, the switch comprises: an input end, an output end, and a control end, the input end of the source IC chip connects to the data processing unit, the output end of the source IC chip connects to the input end of the four switches, the output ends of the four switches connects to the four output ends of the source driving circuit, and the control end of the four switches respectively connect to the four control lines.

2. The liquid crystal panel as claimed in claim 1, wherein each of the sub-pixel rows comprises a first base-color sub-pixel, a second base-color sub-pixel, a third base-color sub-pixel, and a fourth base-color sub-pixel arranged periodically arranged the row direction, within the same arranging period, the polarity of the driving voltage of the first base-color sub-pixel and the fourth base-color sub-pixel are the same, the polarity of the driving voltage of the second base-color sub-pixel and the third base-color sub-pixel are the same, the polarity of the driving voltage of the first base-color sub-pixel is opposite to that of the second base-color sub-pixels, and the polarity of the driving voltage of each of the sub-pixel within each of the arranging period is opposite to that of the sub-pixels within adjacent arranging period having the same color; and each of the source driving circuit comprises four output ends, two of the output ends connect with the first base-color sub-pixel and the fourth base-color sub-pixel within one arranging period, the other two output ends respectively connect to the second base-color sub-pixel and the third base-color sub-pixel within the other arranging period adjacent to the arranging period.

3. The liquid crystal panel as claimed in claim 1, wherein each of the sub-pixel rows comprises a first base-color sub-pixel, a second base-color sub-pixel, a third base-color sub-pixel, and a fourth base-color sub-pixel arranged periodically arranged the row direction, within the same arranging period, the polarity of the driving voltage of the first base-color sub-pixel and the fourth base-color sub-pixel are the same, the polarity of the driving voltage of the second base-color sub-pixel and the third base-color sub-pixel are the same, the polarity of the driving voltage of the first base-color sub-pixel is opposite to that of the second base-color sub-pixels, and the polarity of the driving voltage of each of the sub-pixel within each of the arranging period is the same with that of the sub-pixels within adjacent arranging period having the same color;

each of the source driving circuit comprises four output ends respectively connecting to the first base-color sub-pixel and the third base-color sub-pixel within two adjacent arranging periods, or respectively connecting to the second base-color sub-pixel and the fourth base-color sub-pixel within two adjacent arranging periods.

4. The liquid crystal panel as claimed in claim 3, wherein the liquid crystal panel further comprises a converting circuit connecting with the source driving circuit for converting the voltage data of three base color sets into voltage data of four base color sets, one set of the first base-color sub-pixel, the second base-color sub-pixel, the third base-color sub-pixel, and fourth base-color sub-pixel within one arranging period corresponds to the voltage data of the four base color set.

5. The liquid crystal panel as claimed in claim 4, wherein;

the data processing unit connects with the converting circuit for obtaining the voltage data corresponding to the sub-pixels of two adjacent arranging periods having the same polarity of the driving voltage within the same scanning frame, and for outputting the obtained voltage data to the source IC chip.

6. The liquid crystal panel as claimed in claim 3, wherein the first base-color sub-pixels, the second base-color sub-pixels, the third base-color sub-pixels, and the fourth base-color sub-pixels within one arranging period are respectively red sub-pixel, green sub-pixel, blue sub-pixel, and white sub-pixel.

7. A liquid crystal panel, comprising:

a plurality of source driving circuits and a plurality of sub-pixel rows extending along a row direction, each of the sub-pixel rows comprising a plurality of sub-pixels of different colors and the sub-pixels being arranged periodically along the row direction, within one scanning frame, polarity of driving voltage of at least one sub-pixel within one arranging period being opposite to that of other sub-pixels; and each of the source driving circuit comprising at least two output ends respectively connecting to at least two sub-pixels having the same polarity of driving voltage within the same scanning frame to provide the driving voltage of the same polarity to the at least two sub-pixels, wherein a number of the output ends of each of the source driving circuits being the same with the sub-pixels within one arranging period;

the liquid crystal panel further comprising four control lines, and each of the source driving circuit comprising: a data processing unit, a source IC chip, and four switches; and the source IC chip comprising: an input end and an output end, the switch comprises: an input end, an output end, and a control end, the input end of the source IC chip connects to the data processing unit, the output end of the source IC chip connects to the input end of the four switches, the output ends of the four switches connects to the four output ends of the source driving circuit, and the control end of the four switches respectively connect to the four control lines.

8. The liquid crystal panel as claimed in claim 7, wherein in the same scanning frame, the polarity of each of the sub-pixels within each of the arranging periods is the same with or is opposite to that of the sub-pixels of corresponding color of adjacent arranging period;

each of the source driving circuit is configured for obtaining voltage data corresponding to the sub-pixels within two adjacent arranging periods, wherein the sub-pixels having the same polarity of driving voltage within the same scanning frame, and the source driving circuit is configured for outputting via the four output ends, the output ends respectively connecting to the sub-pixels of two adjacent arranging periods, and wherein the polarity of the driving voltage of sub-pixels in the same scanning frame are the same.

9. The liquid crystal panel as claimed in claim 8, wherein each of the sub-pixel rows comprises a first base-color sub-pixel, a second base-color sub-pixel, a third base-color sub-pixel, and a fourth base-color sub-pixel arranged periodically arranged the row direction, within the same arranging period, the polarity of the driving voltage of the first base-color sub-pixel and the fourth base-color sub-pixel are the same, the polarity of the driving voltage of the second base-color sub-pixel and the third base-color sub-pixel are the same, the polarity of the driving voltage of the first base-color sub-pixel is opposite to that of the second base-color sub-pixels, and the polarity of the driving voltage of each of the sub-pixel within each of the arranging period is opposite to that of the sub-pixels within adjacent arranging period having the same color; and each of the source driving circuit comprises four output ends, two of the output ends connect with the first base-color sub-pixel and the fourth base-color sub-pixel within one arranging period, the other two output ends respectively connect to the second base-color sub-pixel and the third base-color sub-pixel within the other arranging period adjacent to the arranging period.

10. The liquid crystal panel as claimed in claim 8, wherein each of the sub-pixel rows comprises a first base-color sub-pixel, a second base-color sub-pixel, a third base-color sub-pixel, and a fourth base-color sub-pixel arranged periodically arranged the row direction, within the same arranging period, the polarity of the driving voltage of the first base-color sub-pixel and the fourth base-color sub-pixel are the same, the polarity of the driving voltage of the second base-color sub-pixel and the third base-color sub-pixel are the same, the polarity of the driving voltage of the first base-color sub-pixel is opposite to that of the second base-color sub-pixels, and the polarity of the driving voltage of each of the sub-pixel within each of the arranging period is opposite to that of the sub-pixels within adjacent arranging period having the same color; and each of the source driving circuit comprises four output ends, two of the output ends connect with the first base-color sub-pixel and the fourth base-color sub-pixel within one arranging period, the other two output ends respectively connect to the second base-color sub-pixel and the third base-color sub-pixel within the other arranging period adjacent to the arranging period.

11. The liquid crystal panel as claimed in claim 10, wherein the liquid crystal panel further comprises a converting circuit connecting with the source driving circuit for converting the voltage data of three base color sets into voltage data of four base color sets, one set of the first base-color sub-pixel, the second base-color sub-pixel, the third base-color sub-pixel, and fourth base-color sub-pixel within one arranging period corresponds to the voltage data of the four base color set.

12. The liquid crystal panel as claimed in claim 11, wherein;

the data processing unit connects with the converting circuit for obtaining the voltage data corresponding to the sub-pixels of two adjacent arranging periods having the same polarity of the driving voltage within the same scanning frame, and for outputting the obtained voltage data to the source IC chip.

13. The liquid crystal panel as claimed in claim 10, wherein the first base-color sub-pixels, the second base-color sub-pixels, the third base-color sub-pixels, and the fourth base-color sub-pixels within one arranging period are respectively red sub-pixel, green sub-pixel, blue sub-pixel, and white sub-pixel.

14. The liquid crystal panel as claimed in claim 7, wherein the color of each of the sub-pixels being the same with the corresponding sub-pixel within the adjacent arranging period.

15. A driving circuit of liquid crystal panels, comprising:

the liquid crystal panel comprising a plurality of sub-pixel rows extending along a row direction, each of the sub-pixel rows comprising a plurality of sub-pixels of different colors and the sub-pixels being arranged periodically along the row direction, within one scanning frame, polarity of driving voltage of at least one sub-pixel within the arranging period being opposite to that of other sub-pixels; wherein the driving circuit comprising a plurality of source driving circuits, each of the source driving circuit comprising at least two output ends respectively connecting to at least two sub-pixels having the same polarity of driving voltage within the same scanning frame to provide the driving voltage of the same polarity to the at least two sub-pixels, wherein a number of the output ends of each of the source driving circuits being the same with the sub-pixels within one arranging period;

the liquid crystal panel further comprising four control lines, each of the source driving circuit comprising a data processing unit, a source IC chip, and four switches; and the source IC chip comprising: an input end and an output end, the switch comprises: an input end, an output end, and a control end, the input end of the source IC chip connects to the data processing unit, the output end of the source IC chip connects to the input end of the four switches, the output ends of the four switches connects to the four output ends of the source driving circuit, and the control end of the four switches respectively connect to the four control lines.

16. The driving circuit as claimed in claim 15 wherein in the same scanning frame, the polarity of each of the sub-pixels within each of the arranging periods is the same with or is opposite to that of the sub-pixels of corresponding color of adjacent arranging period;

each of the source driving circuit being configured for obtaining voltage data corresponding to the sub-pixels within two adjacent arranging periods, wherein the sub-pixels having the same polarity of driving voltage within the same scanning frame, and the source driving circuit being configured for outputting via the four output ends, the output ends respectively connecting to the sub-pixels of two adjacent arranging periods, and wherein the polarity of the driving voltage of sub-pixels in the same scanning frame are the same.

* * * * *